United States Patent [19]

Cunningham

[11] 4,445,734

[45] May 1, 1984

[54] TELEMETRY DRILL PIPE WITH PRESSURE SENSITIVE CONTACTS

[75] Inventor: Robert A. Cunningham, Bellaire, Tex.

[73] Assignee: Hughes Tool Company, Houston, Tex.

[21] Appl. No.: 327,524

[22] Filed: Dec. 4, 1981

[51] Int. Cl.[3] ..... H01R 4/64

[52] U.S. Cl. ..... 339/16 C; 339/16 RC; 339/117 P

[58] Field of Search ..... 339/15, 16, 61 C, 75 R, 339/75 M, 94 R, 94 M, 117 R, 117 P; 340/853, 856, 857, 858

[56] References Cited

U.S. PATENT DOCUMENTS

| | | | |
|---|---|---|---|
| 749,633 | 1/1904 | Seeley | 339/16 R |
| 2,178,931 | 11/1939 | Crites et al. | 339/16 R |
| 2,232,360 | 2/1941 | Barnett | 340/857 |
| 2,531,120 | 11/1950 | Feaster | 255/4.8 |
| 3,170,137 | 2/1965 | Brandt | 340/857 |
| 3,518,608 | 6/1970 | Papadopoulos | 339/16 |
| 3,518,609 | 6/1970 | Fontenot, Jr. | 339/16 |
| 3,829,816 | 8/1974 | Barry et al. | 339/16 |
| 3,879,097 | 4/1975 | Oertle | 339/16 |
| 4,095,865 | 6/1978 | Denison et al. | 339/16 |
| 4,220,381 | 9/1980 | van der Graff | 339/16 |

FOREIGN PATENT DOCUMENTS 1465950 5/1969 Fed. Rep. of Germany .... 339/94 R

OTHER PUBLICATIONS

"Downhole Measurements While Drilling—A Technology for the 80's" p. 75, FIG. 5, Oct. 1979, Petroleum Engineer.

*Primary Examiner*—John McQuade

*Attorney, Agent, or Firm*—Robert A. Felsman; James E. Bradley

[57] ABSTRACT

A string of earth boring drill pipe has telemetry features. Each section of the drill pipe has a box tool joint on one end and a pin tool joint on the other end, with an insulated wire segment extending through the section. A contact ring is connected to one end of the wire segment and mounted to one of the tool joints. The contact ring has an exposed side. An annular contact member is connected to the other end of the wire segment and has an exposed side for contacting the exposed side of the contact ring when making up with another section. The contact member is laterally flexible and is mounted in an insulating member that is subjected to internal pressure in the drill string for urging the contact member toward the contact ring.

8 Claims, 5 Drawing Figures

TELEMETRY DRILL PIPE WITH PRESSURE SENSITIVE CONTACTS

BACKGROUND OF THE INVENTION

This invention relates in general to telemetry drill pipe, and in particular to drill pipe having a system that enables electrical signals to be passed through the sections of drill pipe to the surface.

Oil and gas wells are normally drilled with a string of drill pipe having a rotatable drill bit located on the bottom. The drill string is rotated to rotate the drill bit to disintegrate the earth formation. Drilling fluid or mud is pumped down the drill string to exit from the bit and return up the borehole. The drill string is made up of sections of pipe, each section being about 30 feet long and secured by threads to other sections to make up a string that is often thousands of feet long.

A method for determining certain downhole characteristics while drilling has long been needed. For example, it would be desirable to know the azimuth and angle of the hole while drilling. Many telemetry systems for drill pipe have been proposed. In many of the proposals, each drill pipe section has a segment of wire that extends its length. Electrical contacts are located at the ends of the wire segment. The contacts are adapted to make a connection automatically when the drill string is screwed together.

Although there are many proposals, these systems are not in general use because of complexity, and electrical leakage and continuity problems. The drill pipe itself is a conductor, and normally the drilling mud is a conductor. Consequently, the contacts must be located in insulators isolated from the metal of the drill pipe and from the mud. Still, due to the high pressure of the drilling fluid, electrical leakage may occur.

In a typical drill string, several hundred contacts must make good connection. These contacts must tightly fit with each other each time the sections of the drill string are connected together. Deposits on the contacts, such as dried drilling mud, may cause lack of continuity. It is not feasible for the drill rig personnel to wipe and clean the contacts during each trip.

SUMMARY OF THE INVENTION

A telemetry system for a drill string is shown of a type that utilizes a conductor within each drill pipe section that extends the length of the section. Electrical contacts are provided at the tool joints for automatically making an electrical connection when the joints are screwed together. In the preferred embodiment, one of the contacts is a rigid ring. The other contact comprises a plurality of individual elements, spaced-apart from each other in a circular array and connected together by flexible wires. The two types of contacts are mounted so that when the drill pipe is screwed together, the sides of the contacts contact each other to make connection. Both of these contacts are mounted in insulators, and the insulator that holds the flexible contact array is located so as to be subject to internal pressure in the drill pipe. Pressure urges the flexible ring radially toward the rigid ring to provide good contact.

Also, in the preferred embodiment, protruberances are provided on the insulators above and below the contacts for wiping the contacts as the tool joints are screwed together. In addition, a cavity may optionally be provided on the outer side of the flexible contacts. A passage admits fluid to the cavity for providing pressure behind the contacts to urge them into tight contact with the rigid ring.

DESCRIPTION OF THE PREFERRED EMBODIMENT

Figures 1, 2:
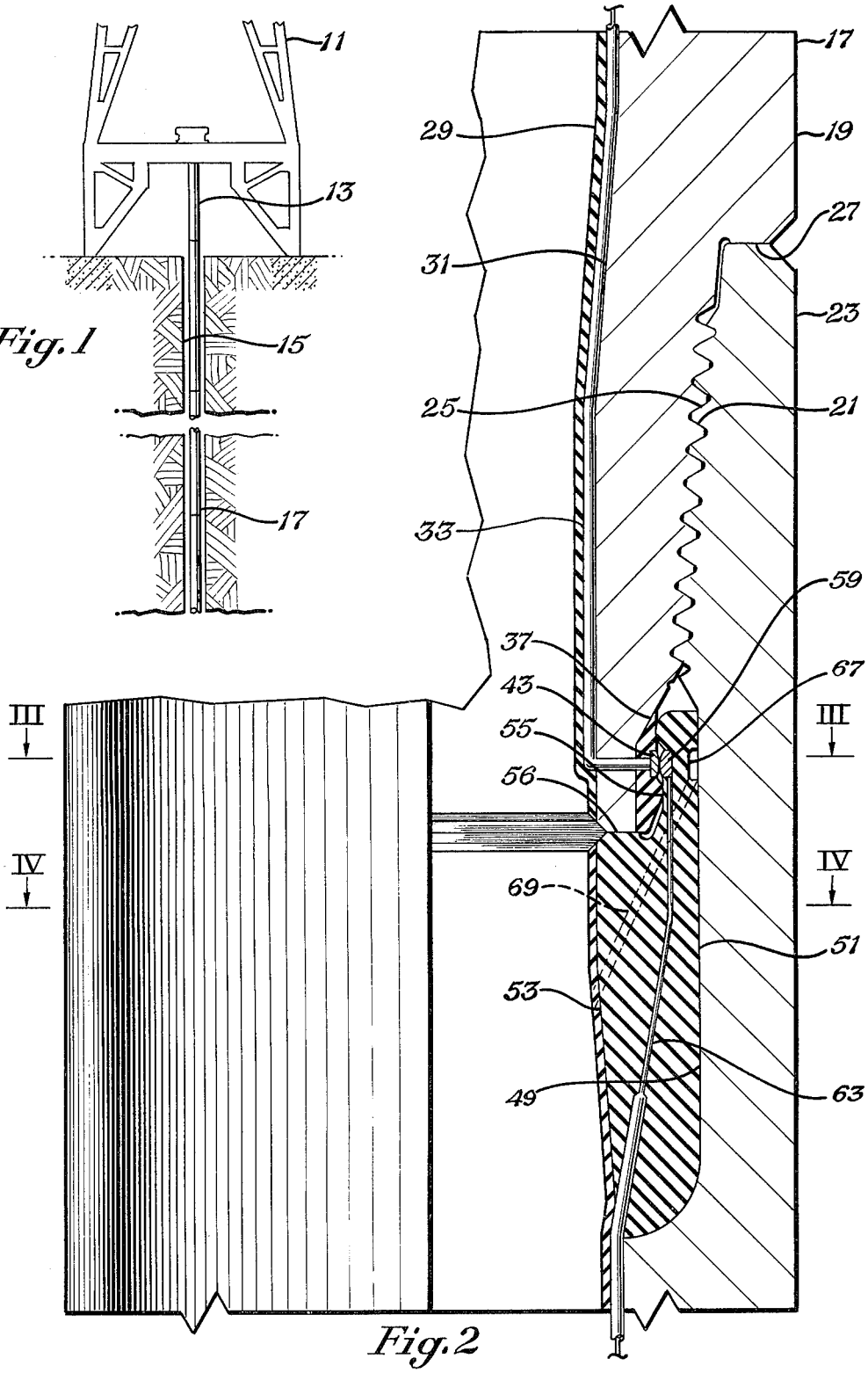
FIG. 1 is a schematic view illustrating a drill rig with a string of drill pipe in the well.
FIG. 2 is a partially sectioned view of interconnected tool joints of two sections of drill pipe constructed in accordance with this invention.

Referring to FIG. 1, a drill rig 11 supports and rotates a string 13 of drill pipe in a well 15. String 13 is made up of a plurality of tubular sections 17 that are screwed together.

Figure 3:
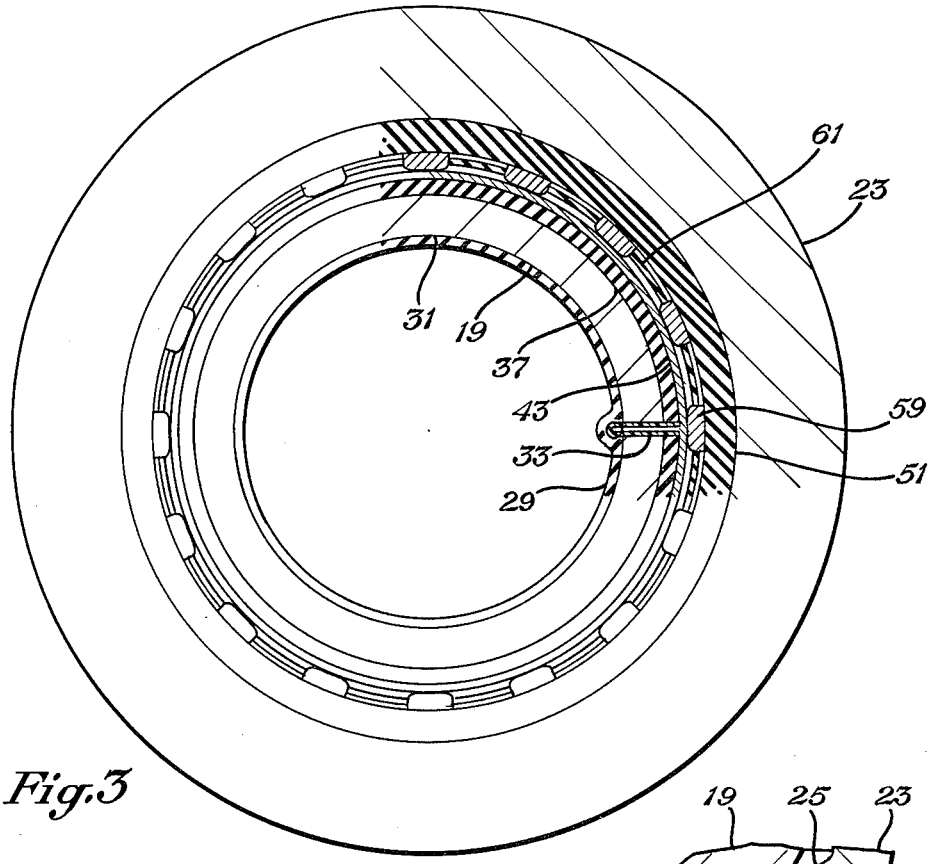
FIG. 3 is a cross-sectional view of the tool joints of FIG. 2, taken along the line III—III of FIG. 2.
Figure 4:
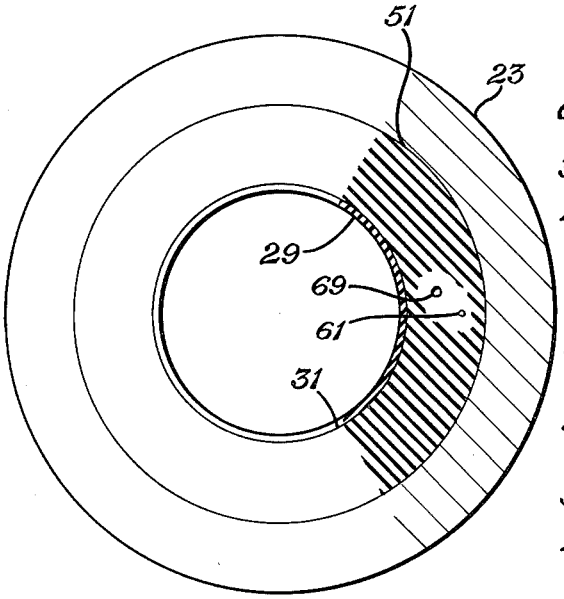
FIG. 4 is a cross-sectional view of the tool joints of FIG. 2, taken along the line IV—IV of FIG. 2.

Referring to FIG. 2, each section 17 has a threaded connection member or tool joint pin 19 located on one end. Pin 19 has external threads 21 on its end. The opposite end of each section 17 has a threaded connection member or tool joint box 23. Box 23 has internal threads 25 that engage the external threads 21 of an adjacent section 17 to make up the drill string. Tool joints 19 and 23 have abutting shoulders 27 that provide a fluid tight seal. Each section 17 has a cylindrical liner 29 of elastomeric, dielectric material bonded concentrically to its inner passage 31. An insulated conductor or wire segment 33 is located within the wall of liner 29. Liner 29 secures and protects wire segment 33. The inner passage of liner 29 is cylindrical except for a small protruberance at the point where wire segment 33 is located, as shown in FIG. 3.

Figure 5:
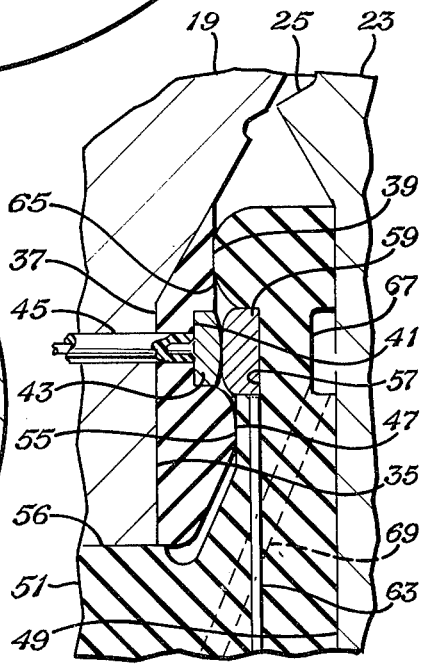
FIG. 5 is an enlarged view of part of the tool joints of FIG. 2.

Referring to FIG. 5, pin 19 has a cylindrical portion 35 at its extremity below threads 21 (FIG. 2). An annular pin insulation member 37 of elastomeric, dielectric material is bonded to cylindrical portion 35. Pin insulation member 37 has an external sidewall 39 that faces radially outward. An annular groove 41 is formed in sidewall 39 concentric with the axis of drill pipe section 17. A pin contact 43 in the shape of a rigid ring of conductive material is tightly carried in groove 41. Pin contact 43 has an exposed side or face that faces radially outward. An end 45 of wire segment 33 extends through a drilled hole in cylindrical portion 35 and is electrically connected to pin contact 43. An annular protruberance or bead 47 is formed with pin insulation member 37 immediately below pin contact 43. Protruberance 47 is rounded and protrudes radially outward past the exposed side of pin contact 41.

Referring to FIG. 2, box 23 has a recess 49 extending below threads 25 for a distance that is about the same length as threads 25. Recess 49 is cylindrical and receives within it an annular box insulation member 51 of elastomeric dielectric material. Box insulation member 51 has an interior that has a lower cylindrical portion 53 to which the upper portion of liner 29 is bonded. The lower cylindrical portion 53 is generally flush with the tool joint passage 31, and is subjected to any internal pressure within passage 31.

Referring again to FIG. 5, box insulation member 51 has an upper cylindrical portion 55 in its interior that is large enough to snugly receive within it the exterior sidewall 39 of the pin insulation member 37 of an adjacent drill pipe section 17. Cylindrical portions 53 and 55 define an upwardly facing shoulder 56 that contacts the end of pin 19. An annular groove 57 is located in the upper portion 55. Referring also to FIG. 3, a plurality of individual box elements or contacts 59 are located in groove 57. Contacts 59 are conductive buttons spaced in a circular array concentric with the axis of drill pipe section 17. Groove 57 could be a series of individual holes, each receiving a contact 59. Contacts 59 are connected together by flexible conductors or wires 61 as shown in FIG. 3. Also, as shown in FIG. 5, an end 63 of wire segment 33 extends through a passage in box insulation member 51 and is electrically connected to the box contacts 59.

A protruberance or bead 65 is formed in the upper cylindrical portion 55 above box contacts 59, protruding radially inward past the box contacts 59. Protruberance 65 is adapted to wipe tightly across pin contact 43 when the tool joints are screwed together. Simultaneously, protruberance 47 wipes tightly across the exposed sides of box contacts 59 when the tool joints 19 and 23 are screwed together. The pin contact 43 and the box contacts 59 are positioned so that when the tool joints 19 and 23 are fully made up, the exposed sides of the contacts will be engaging each other. Pressure exerted on the lower cylindrical portion 53 of the box insulation member 51, deforms the box insulation member to urge the box contacts 59 radially inward into tight contact with the pin contact 43.

Optionally, an annular groove 67 may be provided on the outer wall of the box insulation member 51 radially outward from the box contacts 59. Groove 67 forms with the recess 49 an annular cavity. This cavity is subjected to drilling fluid pressure by means of one or more holes 69 that extend through liner 29 and box insulation member 51 to the groove 67.

In operation, when running in, the sections 17 will be screwed together. As they are screwed together, the protruberances 47 and 65 will wipe the exposed sides of the contacts 59 and 43. The contacts then will come into engagement with each other, as shown in FIG. 5. Once contacted, electrical continuity is provided through the contacts 43 and 59 for wire 33. When drilling commences, drilling fluid will be pumped down the inside of liner 29 and out the drill bit at the bottom of the drill string 13. This pressure will act against box insulation member 51, causing it to deform. Since box insulation member 51 is prevented from moving outward or upward, the deformation presses the box contacts 59 radially inward to insure continuity through wire 33.

Signals from any instrument downhole will be transmitted through wire 33 to the surface. Power can also be transmitted downward through wire 33 to the downhole instrument. The drilling fluid is prevented from contact with contacts 43 and 59 by the sealing action of protruberance 47 with the box insulation member 51. Sealing is also provided through shoulder 56 of box insulation member 51 contacting the lower end of the pin 19. Further pressure radially inward against the box contact 59 may be caused by drilling fluid entering hole 69.

The pin insulation member 37 and the box insulation member 51 serve as mounting means for mounting the contacts to the drill pipe section so that when made up with other sections, one contact fits within the other in electrical contact and insulated from the section. This mounting means also serves for positioning one of the contacts so that it is urged laterally toward the other contact in response to internal pressure in the drill string. The protruberances 47 and 65 serve as wiping means for wiping clean the exposed faces of the contacts as the tool joints are screwed together.

The invention has significant advantages. The system for mounting the insulated wire, using a liner, avoids wear on the wire. Also, any devices passed through the liner will not snag the wire. The means for connecting the ends of the wire segment is simple, yet provides effective means for providing continuity without leakage of electrical current.

While the invention has been shown in only one of its forms, it should be apparent to those skilled in the art that it is not so limited but is susceptible to various changes and modifications without departing from the spirit of the invention.

I claim:

1. In a string of drill pipe having a plurality of sections adapted to be screwed together, and a conductor segment extending through each section, an improved means for electrically coupling each segment together when the string is made up, comprising:

a pair of electrical contacts, each connected to opposite ends of the conductor segment; and mounting means for mounting the contacts to each of the sections of pipe so that when made up to other sections, one contact fits within the other in electrical engagement and insulated from the sections, and for positioning the contacts so that one is urged laterally toward the other in response to internal pressure in the drill string.

2. In a string of drill pipe having a plurality of sections, each section having a threaded box connection member on one end and a threaded pin connection member on the other end, and an insulated conductor segment extending through each section, an improved means for electrically coupling each conductor segment when the string is made up, comprising:

a rigid contact ring connected to one end of the conductor segment and mounted to one of the connection members, the contact ring having an exposed side;

an annular contact member connected to the other end of the conductor segment and having an exposed side for engagement with the exposed side of the contact ring of another section when made up, the contact member being laterally flexible; and mounting means for mounting the contact member to the other of the connection members so that internal pressure in the string urges the member laterally into tight contact with the contact ring when made up.

3. In a string of drill pipe having a plurality of sections, each section having a threaded box connection member on one end and a pin connection member on the other end, and an insulated conductor segment extending through each section, an improved means for electrically coupling each conductor segment when the string is made up, comprising:

a first insulation member mounted to one of the connection members and having a sidewall with an annular groove;

a rigid contact ring located in the groove, connected to one end of the conductor segment, and having an exposed side;

a second insulation member mounted to the other of the connection members and having a sidewall dimensioned to mate with the sidewall of the first insulation member of another section when made up; and a plurality of contact elements electrically connected to the other end of the conductor segment and secured to the sidewall of the second insulation member in a circular array, each contact element having an exposed side for contacting the exposed side of the contact ring of another section when made up;

the second insulation member having a portion exposed to internal pressure in the drill string to urge the contact elements laterally into tight contact with the contact ring.

4. In a string of drill pipe having a plurality of sections, each section having a tool joint box on one end and a tool joint pin on the other end with external threads for engaging internal threads of the tool joint box on an adjacent section, each section having an insulated conductor segment extending along its length, an improved means for electrically coupling each conductor segment when the string is made up, comprising:

a pin insulation member bonded to the end of the pin below the threads, the pin insulation member having a sidewall with an external annular groove;

a rigid contact ring located in the groove, connected to one end of the conductor segment and having an exposed side;

an annular box insulation member bonded inside the box below the threads, the box insulation member having an interior wall with a portion sized to closely receive the sidewall of the pin insulation member of another section when made up;

a plurality of contact elements electrically connected to the other end of the conductor segment and mounted in the interior wall of the box insulation member, each contact element having an exposed side facing radially inward for contact with the contact ring of another section when made up; and a portion of the box insulation member interior wall being flush with an interior wall of the box to expose the box insulation member to internal pressure in the drill string.

5. In a string of drill pipe having a plurality of sections, each section having a tool joint box on one end and a tool joint pin on the other end with external threads for engaging internal threads of the tool joint box on an adjacent section, each section having an insulated conductor segment extending along its length, an improved means for electrically coupling each conductor segment when the string is made up, comprising:

a pin insulation member bonded to the end of the pin below the threads, the pin insulation member having a sidewall with an external annular groove;

a rigid contact ring located in the groove, connected to one end of the conductor segment and having an exposed side;

an annular box insulation member bonded inside the box below the threads;

a plurality of contact elements electrically connected to the other end of the conductor segment and mounted to an interior wall of the box insulation member, each contact element having an exposed side facing radially inward for contact with the contact ring of another section when made up;

an annular groove formed in the box insulation member radially outward from the contact elements and defining with the interior of the box an annular cavity; and passage means extending from the interior wall of the box insulation member to the cavity for transmitting drilling fluid to the cavity to apply pressure radially inward against the contact elements.

6. In a string of drill pipe having a plurality of sections, each section having a tool joint box on one end a tool joint pin on the other end, and an insulated conductor segment extending through each section, an improved means for electrically coupling each conductor segment when the string is made up, comprising:

a pin insulation member mounted to the end of the pin and having an exterior sidewall;

a pin contact connected to one end of the conductor segment and mounted to the exterior sidewall with an exposed side facing laterally outward;

a box insulation member mounted to the box and having an interior sidewall for receiving the exterior sidewall of the pin insulation member when another section is made up;

a box contact connected to the other end of the conductor segment and mounted to the interior sidewall of the box insulation member with an exposed side for engagement with the exposed side of the pin contact when made up; and elastomeric wiping means for wiping the exposed sides of the box and pin contacts when the tool joints are screwed together and just prior to the make-up of the contacts with each other.

7. In a string of drill pipe having a plurality of sections, each section having a tool joint box on one end and a tool joint pin on the other end, and a conductor segment extending through each section, an improved means for electrically coupling each conductor segment when the string is made up, comprising:

a pin insulation member mounted to the end of the pin and having an exterior sidewall;

a pin contact connected to one end of the conductor segment and mounted to the exterior sidewall with an exposed side facing laterally outward, the pin insulation member having an annular protruberance located below the pin contact and protruding radially outward;

a box insulation member mounted to the box and having an interior sidewall for receiving the exterior sidewall of the pin insulation member when another section is made up; and a box contact connected to the other end of the conductor segment and mounted to the interior sidewall of the box insulation member with an exposed side for contact with the exposed side of the pin contact when mae up, the box insulation member having an annular protruberance located above the box contact and protruding radially inward for wiping the exposed side of the pin contact when making up, the protruberance of the pin insulation member wiping the exposed side of the box contact when making up.

8. A tubular section of drill pipe having an axial passage with a cylindrical wall, a tool joint pin on one end with external threads and a tool joint box on the other end with internal threads, comprising in combination:

an insulated conductor segment extending along the length of the section;

an elastomeric pin insulator member mounted on the end of the pin and having a sidewall with an exterior annular groove and an annular protruberance located below the groove and protruding radially outward;

a contact ring electrically coupled to one end of the conductor segment, mounted in the groove and having an exposed side facing radially outward;

an elastomeric box insulator member mounted in the box;

a plurality of contact elements electrically connected to the other end of the conductor segment and mounted in the interior sidewall of the box insulator member in a circular array, the contact elements being spaced apart, electrically connected together by flexible conductors, and having exposed sides facing radially inward for engaging the exposed side of the contact ring of another section when making up;

the box insulator member having an annular protruberance located above the contact elements and protruding radially inward for wiping during make up the exposed side of the contact ring, while the protruberance of the pin insulator member wipes the exposed sides of the contact elements;

a portion of the interior sidewall of the box insulator member being exposed to drilling fluid pressure for deforming the box insulator member to urge the contact elements into tight contact with the contact ring.

* * * * *